United States Patent [19]

Sifferman

[11] 4,285,356

[45] Aug. 25, 1981

[54] METHOD OF TRANSPORTING VISCOUS HYDROCARBONS

[75] Inventor: Thomas R. Sifferman, Ponca City, Okla.

[73] Assignee: Conoco, Inc., Ponca City, Okla.

[21] Appl. No.: 84,334

[22] Filed: Oct. 12, 1979

[51] Int. Cl.[3] ..... F17D 1/17

[52] U.S. Cl. ..... 137/13; 252/8.55 R; 252/312

[58] Field of Search ..... 252/8.3, 8.55 R, 551, 252/312; 137/13; 260/458 R

[56] References Cited

U.S. PATENT DOCUMENTS

| | | | |
|---|---|---|---|
| 3,491,835 | 1/1970 | Gagle | 137/13 |
| 3,775,349 | 11/1973 | Tuvell et al. | 252/551 X |
| 3,931,271 | 1/1976 | Baumann et al. | 260/458 |
| 4,099,537 | 7/1978 | Kalfoglou et al. | 137/13 |
| 4,108,193 | 8/1978 | Flournoy et al. | 252/8.55 X |
| 4,118,361 | 10/1978 | Lundberg | 260/31.8 G |

FOREIGN PATENT DOCUMENTS

| | | | |
|---|---|---|---|
| 761924 | 7/1971 | Belgium | 260/458 R |

*Primary Examiner*—Herbert B. Guynn

*Attorney, Agent, or Firm*—Bayless E. Rutherford, Jr.

[57] ABSTRACT

An improvement in the method of transporting viscous hydrocarbons through pipes is disclosed. Briefly, the method comprises adding water containing an effective amount of (a) an anionic alkyl polyether ethoxylated sulfate or (b) a combination of this material with an alcohol ether sulfate. The resulting oil-in-water dispersion has a lower viscosity and is more easily transported.

13 Claims, No Drawings

METHOD OF TRANSPORTING VISCOUS HYDROCARBONS

BACKGROUND OF THE INVENTION

1. Field of the Invention

The invention is in the general field of improved methods of pumping viscous hydrocarbons through a pipe, such as a well-bore or a pipeline.

2. General Background

The movement of heavy crudes through pipes is difficult because of their high viscosity and resulting low mobility. One method of improving the movement of these heavy crudes has included adding to the crude lighter hydrocarbons (e.g. kerosine distillate). This reduces the viscosity and thereby improves the mobility. This method has the disadvantage that it is expensive and the kerosine distillate is becoming difficult to obtain.

Another method of improving the movement of these heavy crudes is by heating them. This requires the installation of expensive heating equipment and thus is an expensive process.

The use of oil-in-water emulsions, which use surfactants to form the emulsion, is known in the art. While many surfactants serve to reduce the viscosity the effectiveness of various surfactants varies widely. Some surfactants are very effective, while others are barely effective. In fact such a wide variation is present in the effectiveness of surfactants that in general it can be concluded that the effectiveness of a particular surfactant, or combination of surfactants, is not predictable.

I have found that an aqueous solution of the following materials is effective in reducing the viscosity of viscous hydrocarbons: (a) an anionic alkyl polyether ethoxylated sulfate or (b) a combination of this material with an alcohol ether sulfate.

BRIEF SUMMARY OF THE INVENTION

Briefly stated, the present invention is directed to an improvement in the method of pumping a viscous hydrocarbon through a pipe wherein the improvement comprises forming an oil-in-water emulsion by adding to said hydrocarbon from about 20 to about 80 volume percent water containing an effective amount of (a) about 20 to about 100 weight percent of an anionic alkyl polether ethoxylated sulfate and (b) about 0 to about 80 weight percent of an alcohol ether sulfate.

The precise nature of the materials will be provided in the detailed description.

DETAILED DESCRIPTION

Insofar as is known my method is suitable for use with any viscous crude oil. It is well known that crude oils often contain a minor amount of water.

The amount of water which is added to the hydrocarbon is suitably in the range of about 20 to about 80 volume percent based on the hydrocarbon. A preferred amount of water is in the range of about 30 to 60 volume percent. The water can be pure or can have a relatively high amount of dissolved solids. Any water normally found in the proximity of a producing oil-well is suitable.

Suitable anionic alkyl polyether ethoxylated sulfates for use in my invention are represented by the formula $$R(O\overset{\overset{CH_3}{|}}{C}HCH_2)_a(OCH_2CH_2)_bOSO_3M$$

wherein R is an alkyl group containing about 8 to about 14 carbon atoms, preferably about 10 to about 12 carbon atoms, a is a number in the range of 1 to about 30, preferably about 2 to about 13, b is a number in the range of 1 to about 20, preferably 1 to about 3, and M is sodium, potassium or ammonium.

Suitable anionic alkyl polyether ethoxylated sulfates are available from Stepan Chemical Company under the designation Polystep B-13, B-14 and B-28.

Suitable alcohol ether sulfates (also known as ethoxylated alcohol sulfates) for use in my invention can be represented by the following structural formula $$[CH_3(CH_2)_xCH_2(OCH_2CH_2)_nOSO_3]M$$

wherein x is an integer in the range of about 8 to about 20, preferably from about 10 to about 16, n is a number in the range of about 1 to about 50, preferably about 2 to about 30, more preferably about 3 to about 12, and M is Na, K, or $NH_4$, but preferably is sodium.

The alcohol moiety of the ethoxylated alcohol sulfate can be an even or odd number or a mixture thereof. Preferably, the alcohol moiety is an even number. Also, preferably, the alcohol moiety contains 12 to 18 carbon atoms.

The relative amounts of anionic alkyl polyether ethoxylated sulfate and alcohol ether sulfate used in my invention are as follows:

| | Anionic Alkyl Polyether Ethoxylated Sulfate (Wt. %) | Alcohol Ether Sulfate |
|---|---|---|
| Suitable | 20–100 | 0–80 |
| Preferred | 40–60 | 60–40 |

As is implied by the figures shown above the use of the anionic alkyl polyether ethoxylated sulfate alone gives very good results in my invention. However, the use of the described combination provides even better results.

The amount of total surfactant used in my invention, based on the hydrocarbon, is shown below.

| | Amount of Surfactant (parts per million) |
|---|---|
| Suitable | 50–20,000 |
| More Suitable | 125–2,000 |
| Preferred | 200–800 |

In order to illustrate the nature of the present invention still more clearly the following examples will be given. It is to be understood, however, that the invention is not to be limited to the specific conditions or details set forth in these examples except insofar as such limitations are specified in the appended claims.

The following materials were used in the tests described herein:

Crude Oil—Goodwin lease crude from Cat Canyon oil field, Santa Maria, Calif.

Water—Goodwin synthetic (Water prepared in laboratory to simulate water produced at the well. It contained 4720 ppm total solids.)

Viscosities were determined using a Brookfield viscometer, Model LVT with No. 3 spindle. The procedure is described below.

The materials tested were the following.

Surfactants A–C were anionic alkyl polyether ethoxylated sulfates represented by the formula shown in the foregoing wherein R, a, b, and M are as shown in the following table.

| Surfactant | R(1) | a(PO)(2) | b(EO)(3) | M |
|---|---|---|---|---|
| A | 8–14 | 2.8 | 1.7 | $NH_4$ |
| B | 8–14 | 2.4 | 1.5 | Na |
| C | 8–14 | 12.2 | 1.8 | Na |

(1)Number of carbn atoms
(2)PO = propylene oxide
(3)EO = ethylene oxide

Surfactants D and E were sodium alkyl ether sulfates represented by the formula shown in the foregoing wherein the alcohol moiety and the moles of ethylene oxide are as shown in the following table.

| Surfactant | No. of Carbon Atoms Alcohol Moiety | Moles of Ethylene Oxide |
|---|---|---|
| D | 12–14(1) | 3 |
| E | 16–18(1) | 10.5 |

(1)The alcohol moiety contains two more carbon atoms than shown for x in the formula.

Test Procedure

Three hundred ml of crude oil, preheated in a large container to about 93° C. in a laboratory oven, was transferred to a Waring blender and stirred at medium speed until homogeneous. Stirring was stopped, temperature recorded, and the viscosity measured using the Brookfield viscometer at RPM's (revolutions per minute) of 6, 12, 30 and 60 and then back down 30, 12, and 6 RPM. Viscosity was calculated by using a multiplication factor of 200, 100, 40 and 20 for the respective speeds times the dial reading on the viscometer.

It may be well to mention that the final result at 6 RPM is an indication of the stability of the solution being tested.

The test was repeated using 300 ml crude oil plus 300 ml of the Goodwin synthetic water containing varying amounts of the described surfactants and combinations of the described surfactants.

An additional procedure was used on the crude oil-water-surfactant composition. This procedure consisted of stirring the emulsions a second time, allowing them to set for two minutes upon completion of stirring, then making the viscosity determination as previously. This procedure is a more severe test of long term stability for emulsions.

The results for the crude alone are not being stated here. These results were in the range of 1500–9500 cp at 6 RPM.

The test results are shown in the following table.

Only the initial and final 6 RPM values are being given for the two procedures.

| Surfactant | Concentration (ppm) | First Procedure Initial | First Procedure Final | Second Procedure Initial | Second Procedure Final |
|---|---|---|---|---|---|
| B | 250 | 20 | 20 | 120 | 180 |
| C | 250 | 40 | 80 | 500 | 360 |
| A | 500 | 40 | 400 | 400 | 320 |

-continued

| Surfactant | Concentration (ppm) | First Procedure Initial | First Procedure Final | Second Procedure Initial | Second Procedure Final |
|---|---|---|---|---|---|
| B | 500 | 400 | 140 | 140 | 80 |
| C | 500 | 20 | 60 | 60 | 60 |
| D | 500 | 700 | 400 | 300 | 200 |
| A + D | 250 + 250 | 80 | 40 | 40 | 60 |
| B + D | 250 + 250 | 20 | 40 | 20 | 20 |
| C + D | 250 + 250 | 260 | 240 | 160 | 140 |
| C + E | 250 + 250 | 60 | 60 | 40 | 40 |
| A | 1,000 | 300 | 1280 | (1) | (1) |
| C | 1,000 | 80 | 200 | (1) | (1) |
| D | 1,000 | 100 | 880 | (1) | (1) |

(1) Tests were not run.

The results stated above show that Surfactants B and C at 250 ppm have good first procedure viscosities but are not so good in stability. At 500 ppm, B and C showed improved stability. Products A, B, and C, as compared to other surfactants tested in other work, give good overall results.

The combination of Surfactants B and D at 250 ppm each give excellent results.

Thus, having described the invention in detail, it will be understood by those skilled in the art that certain variations and modifications may be made without departing from the spirit and scope of the invention as defined herein and in the appended claims:

I claim:

1. In the method of transporting a viscous hydrocarbon through a pipe, the improvement which comprises forming an oil-in-water emulsion of lower viscosity to facilitate transporting said hydrocarbon through said pipe by adding to said hydrocarbon from about 20 to about 80 volume percent of an aqueous solution containing an effective amount, in the range of about 125 to about 2,000 parts per million based on said hydrocarbon, of (a) about 40 to about 60 weight percent of an anionic alkyl polyether ethoxylated sulfate and (b) about 60 to about 40 weight percent of an alcohol ether sulfate, said anionic alkyl polyether ethoxylated sulfate being represented by the formula $$R(O\overset{\overset{CH_3}{|}}{C}HCH_2)_a(OCH_2CH_2)_bOSO_3M$$

wherein R is a $C_8$ to $C_{14}$ alkyl group, a is a number in the range of 2 to about 13, b is a number in the range of 1 to about 3, and M is sodium, potassium or ammonium, and said alcohol ether sulfate being represented by the formula $$[CH_3(CH_2)_xCH_2(OCH_2CH_2)_nOSO_3]M$$

wherein x is an integer in the range of about 10 to about 16, n is a number in the range of 3 to about 12, and M is sodium, potassium or ammonium.

2. The method of claim 1 wherein, in the alcohol ether sulfate M is sodium.

3. The method of claim 2 wherein, in the anionic alkyl polyether ethoxylated sulfate, R is a $C_{10}$ to $C_{12}$ alkyl group and M is sodium.

4. The method of claim 2 wherein, in the anionic alkyl polyether ethoxylated sulfate, R is a $C_{10}$ to $C_{12}$ alkyl group and M is ammonium.

5. The method of claim 1 wherein (a) the amount of aqueous solution added to said hydrocarbon is in the range of about 30 to about 60 volume percent based on said hydrocarbon and (b) the hydrocarbon is a crude oil.

6. The method of claim 5 wherein the combined amount of anionic alkyl polyether ethoxylated sulfate and alcohol ether sulfate is in the range of about 200 to about 800 parts per million.

7. The method of claim 6 wherein, in the alcohol ether sulfate M is sodium.

8. The method of claim 7 wherein, in the anionic alkyl polyether ethoxylated sulfate, R is a $C_{10}$ to $C_{12}$ alkyl group and M is sodium.

9. The method of claim 7 wherein, in the anionic alkyl polyether ethoxylated sulfate, R is a $C_{10}$ to $C_{12}$ alkyl group and M is ammonium.

10. The method of claim 1 wherein (a) the hydrocarbon is a crude oil and (b) there is used about 50 percent of an aqueous solution containing about 250 parts per million of anionic alkyl polyether ethoxylated sulfate and about 250 parts per million of alcohol ether sulfate, wherein in the alcohol ether sulfate the alcohol moiety contains 12 to 14 carbon atoms, n is 3 and M is sodium.

11. The method of claim 10 wherein, in the anionic alkyl polyether ethoxylated sulfate, R is a $C_8$ to $C_{14}$ alkyl group, a is about 2.8, b is about 1.7, and M is ammonium.

12. The method of claim 10 wherein, in the anionic alkyl polyether ethoxylated sulfate, R is a $C_8$ to $C_{14}$ alkyl group, a is about 2.4, b is about 1.5, and M is sodium.

13. The method of claim 10 wherein, in the anionic alkyl polyether ethoxylated sulfate, R is a $C_8$ to $C_{14}$ alkyl group, a is about 12.2, b is about 1.8, and M i sodium.

* * * * *